US008894362B2

(12) United States Patent
Fretwell

(10) Patent No.: US 8,894,362 B2
(45) Date of Patent: Nov. 25, 2014

(54) TORQUE PIN FOR ADJUSTING POSITION OF BLADE RING RELATIVE TO ROTOR IN A GAS TURBINE ENGINE

(75) Inventor: Richard M. Fretwell, Houston, TX (US)

(73) Assignee: Siemens Energy, Inc., Orlando, FL (US)

( * ) Notice: Subject to any disclaimer, the term of this patent is extended or adjusted under 35 U.S.C. 154(b) by 1002 days.

(21) Appl. No.: 12/908,968

(22) Filed: Oct. 21, 2010

(65) Prior Publication Data

US 2012/0099990 A1 Apr. 26, 2012

(51) Int. Cl.
*F01D 25/24* (2006.01)
*F01D 25/28* (2006.01)

(52) U.S. Cl.
CPC ..... *F01D 25/246* (2013.01); *F01D 25/28* (2013.01); *F05D 2230/644* (2013.01)
USPC ..... 415/174.1; 415/128; 415/209.2; 415/210.1; 415/213.1; 415/214.1; 29/889.2; 29/889.22; 29/407.01; 29/407.05; 29/525.02; 29/525.11

(58) Field of Classification Search
USPC ..... 415/173.2, 174.1, 126, 128, 415/209.2–209.4, 210.1, 213.1, 214.1; 29/889.22, 889.2, 407.02, 407.05, 29/407.01, 525.01, 525.02, 525.11
See application file for complete search history.

(56) References Cited

U.S. PATENT DOCUMENTS

| | | | | |
|---|---|---|---|---|
| 4,112,582 | A * | 9/1978 | Beckershoff | 33/655 |
| 4,204,803 | A * | 5/1980 | Leger et al. | 415/209.2 |
| 4,957,412 | A | 9/1990 | Olson et al. | |
| 4,990,056 | A | 2/1991 | McClain et al. | |
| 6,547,523 | B2 * | 4/2003 | Nelligan | 415/209.2 |
| 6,623,242 | B2 | 9/2003 | Vranjes et al. | |
| 2006/0251514 | A1 * | 11/2006 | Burdgick | 415/214.1 |
| 2007/0119174 | A1 * | 5/2007 | Russo et al. | 60/645 |
| 2009/0110552 | A1 | 4/2009 | Anderson et al. | |
| 2009/0232651 | A1 * | 9/2009 | Ballard et al. | 415/214.1 |

* cited by examiner

*Primary Examiner* — Christopher Verdier

(57) ABSTRACT

A method is provided for adjusting a position of a blade ring relative to a rotor in a gas turbine engine. An outer casing surrounds the blade ring and the blade ring surrounds the rotor. The method comprises: determining an amount of vertical movement needed to reposition the blade ring relative to the rotor so that the blade ring is at a desired position relative to the rotor; providing at least one torque pin assembly comprising a torque pin and a variable thickness defining structure; determining a change in the thickness of the variable thickness defining structure so as to effect the necessary vertical movement of the blade ring; changing the thickness of the variable thickness defining structure; and coupling the at least one torque pin assembly to the outer casing such that at least one torque pin engages the blade ring. A gas turbine engine is provided having structure for adjusting a position of a blade ring relative to a rotor.

4 Claims, 4 Drawing Sheets

$$SD = \frac{\Delta Y}{\sin \Theta}$$

TORQUE PIN FOR ADJUSTING POSITION OF BLADE RING RELATIVE TO ROTOR IN A GAS TURBINE ENGINE

FIELD OF THE INVENTION

The present invention relates to a torque pin assembly for adjusting a position of a blade ring relative to a rotor in a gas turbine engine and a process for effecting such an adjustment.

BACKGROUND OF THE INVENTION

It is known to use torque pins to adjust a position of a blade ring relative to a rotor in a gas turbine engine, wherein the blade ring surrounds the rotor. The torque pins have an end section which defines a thickness corresponding to a vertical distance between the blade ring and the rotor. If the blade ring needs to be moved away from the rotor in a vertical direction, the end section of each pin is machined to remove an amount of material corresponding to a vertical movement change needed to reposition the blade ring relative to the rotor. Hence, each torque pin must be removed and machined to grind off metal to reduce the thickness of the end section. Such a process is time consuming and costly. If the blade ring needs to be moved closer to the rotor, metal cannot be added to the torque pins and new torque pins must be used, which is costly and undesirable.

SUMMARY OF THE INVENTION

In accordance with a first aspect of the present invention, a method is provided for adjusting a position of a blade ring relative to a rotor in a gas turbine engine where an outer casing surrounds the blade ring and the blade ring surrounds the rotor. The method may comprise determining an amount of vertical movement needed to reposition the blade ring relative to the rotor so that the blade ring is at a desired position relative to the rotor. The method may also comprise providing at least one torque pin assembly comprising a torque pin and a variable thickness defining structure, and determining a change in the thickness of the variable thickness defining structure so as to effect the necessary vertical movement of the blade ring. The method may further comprise changing the thickness of the variable thickness defining structure, and coupling the at least one torque pin assembly to the outer casing such that at least one torque pin engages the blade ring.

The variable thickness defining structure may comprise one or more shims removably coupled to the torque pin.

The torque pin may comprise an elongated body for projecting radially inward through a bore in the outer casing and engaging the blade ring. The elongated body may have at least one recess and the one or more shims may be received in the at least one recess.

The variable thickness defining structure may further comprise at least one removable member, such as a puck, for being received in the at least one recess, and structure to secure the at least one removable member and the one or more shims to the elongated body.

Determining the change in the thickness of the variable thickness defining structure may be calculated using the following equation:

$$SD=\Delta Y/\sin\theta$$

where SD denotes a change in the thickness of the variable thickness defining structure;

ΔY denotes the determined vertical movement of the blade ring; and

θ denotes the angle between vertical and a longitudinal axis of the at least one torque pin assembly.

The final thickness of the variable thickness defining structure is equal to the initial thickness of the variable thickness defining structure plus SD, i.e., the change in the thickness of the variable thickness defining structure.

In accordance with a second aspect of the present invention, a gas turbine engine is provided. The gas turbine may comprise an outer casing, a rotor located within the outer casing, a blade ring positioned between the rotor and the outer casing, and at least one torque pin assembly comprising a variable thickness defining structure coupled to the outer casing and engaging the blade ring so as to determine the vertical spacing between the blade ring and the rotor.

The at least one torque pin assembly may comprise first and second torque pin assemblies comprising first and second torque pins extending through corresponding bores in the engine casing and having longitudinal axes extending at an angle to vertical.

BRIEF DESCRIPTION OF THE DRAWINGS

While the specification concludes with claims particularly pointing out and distinctly claiming the present invention, it is believed that the present invention will be better understood from the following description in conjunction with the accompanying drawings, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
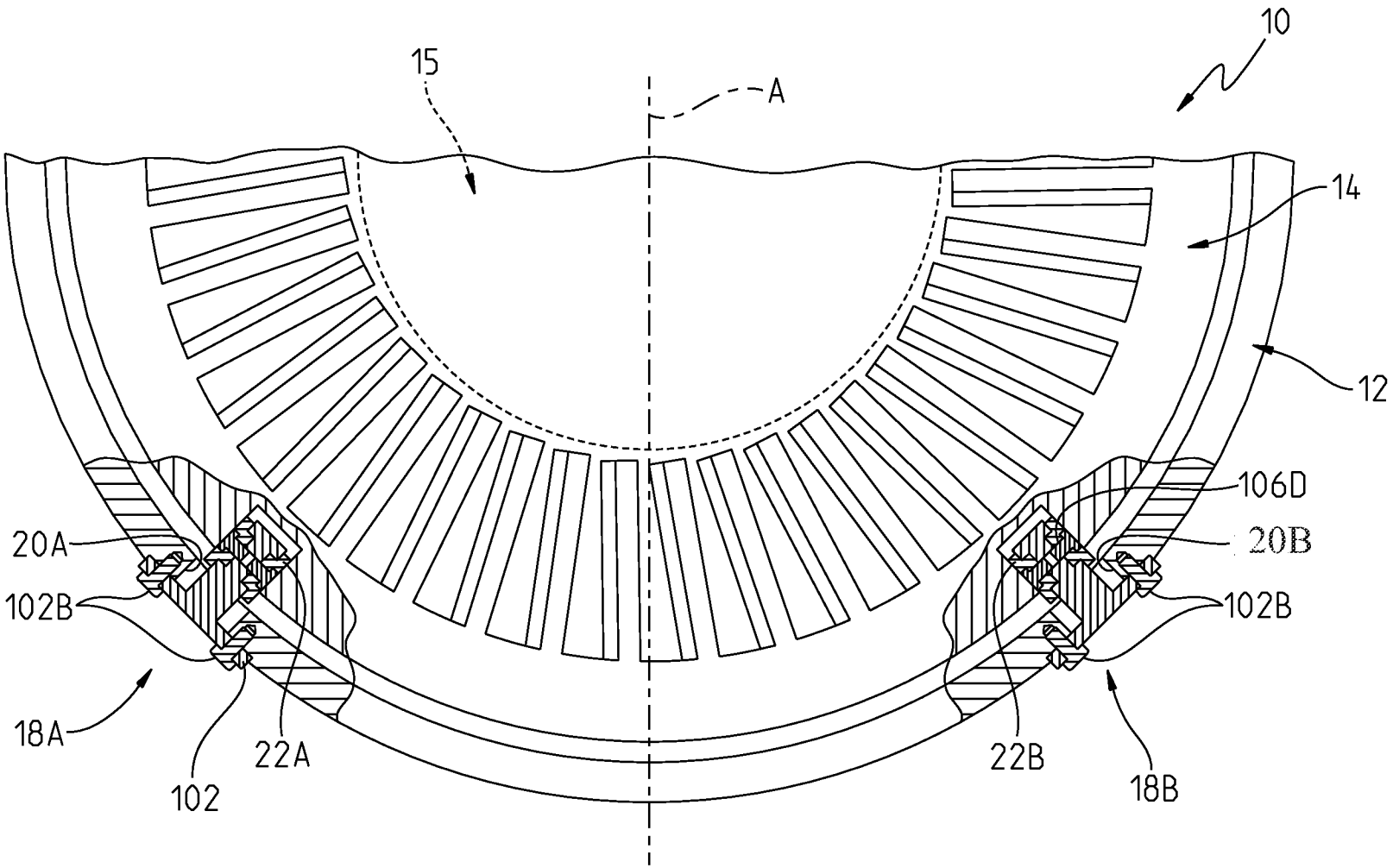
FIG. 1 is a partial cross-sectional view of an outer casing and a blade ring in gas turbine engine.

Referring to FIG. 1, there is illustrated a portion of a gas turbine or a compressor, generally designated 10, of a gas turbine engine. The engine further comprises a combustor (not shown). The engine also comprises an outer casing 12, which defines an outer section for each of the compressor, combustor and gas turbine. A rotor 15 extends through the engine. Rotor portions extending through the compressor and gas turbine are defined by a plurality of discs. Each disc can host a row of rotating airfoils, commonly referred to as blades. The rows of blades alternate with rows of stationary airfoils or vanes. The vanes form part of a blade ring or vane carrier 14. The outer casing 12 surrounds the blade ring 14 and the blade ring 14 surrounds the rotor 15, see FIG. 1. The outer casing 12 is fixed and, hence, stationary relative to the rotor 15, which is rotatable about a center axis extending axially through the engine.

To connect the blade ring 14 to the outer casing and adjust a position of the blade ring 14 relative to the rotor 15, first and second torque pin assemblies 18A and 18B are provided. The torque pin assemblies 18A, 18B pass through corresponding access openings or bores 20A and 20B in the outer casing 12 and extend into corresponding first and second recesses 22A and 22B in the blade ring 14. In the embodiment illustrated in FIG. 1, the torque pin assemblies 18A and 18B are circumferentially spaced apart from one another and further spaced from a vertical axis A passing through a center of the gas turbine engine, see FIG. 1. A greater number than two of the torque pin assemblies at different circumferential locations may also be used.

Figure 2:
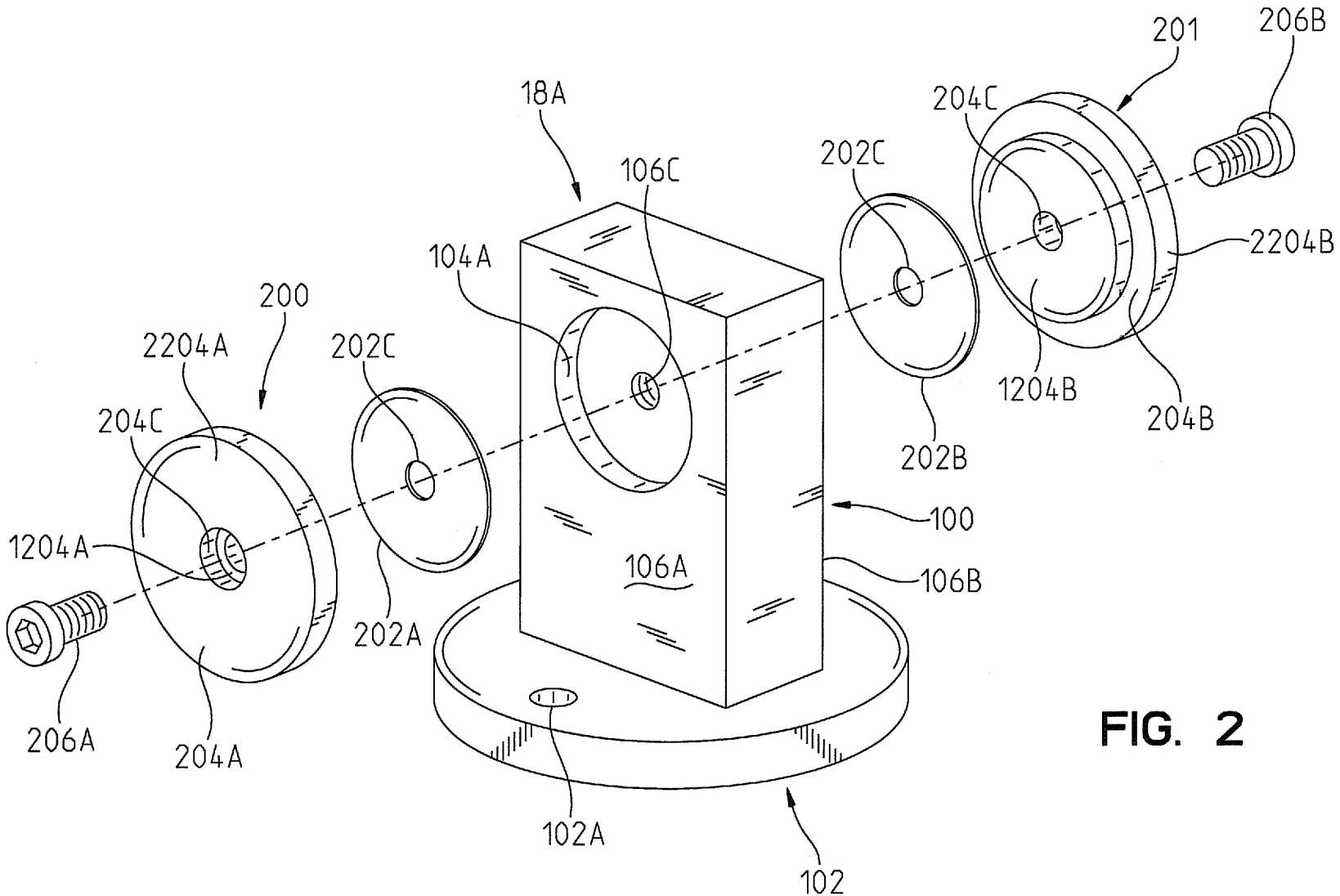
FIG. 2 is an exploded view of a torque pin assembly according to the present invention.
Figure 3:
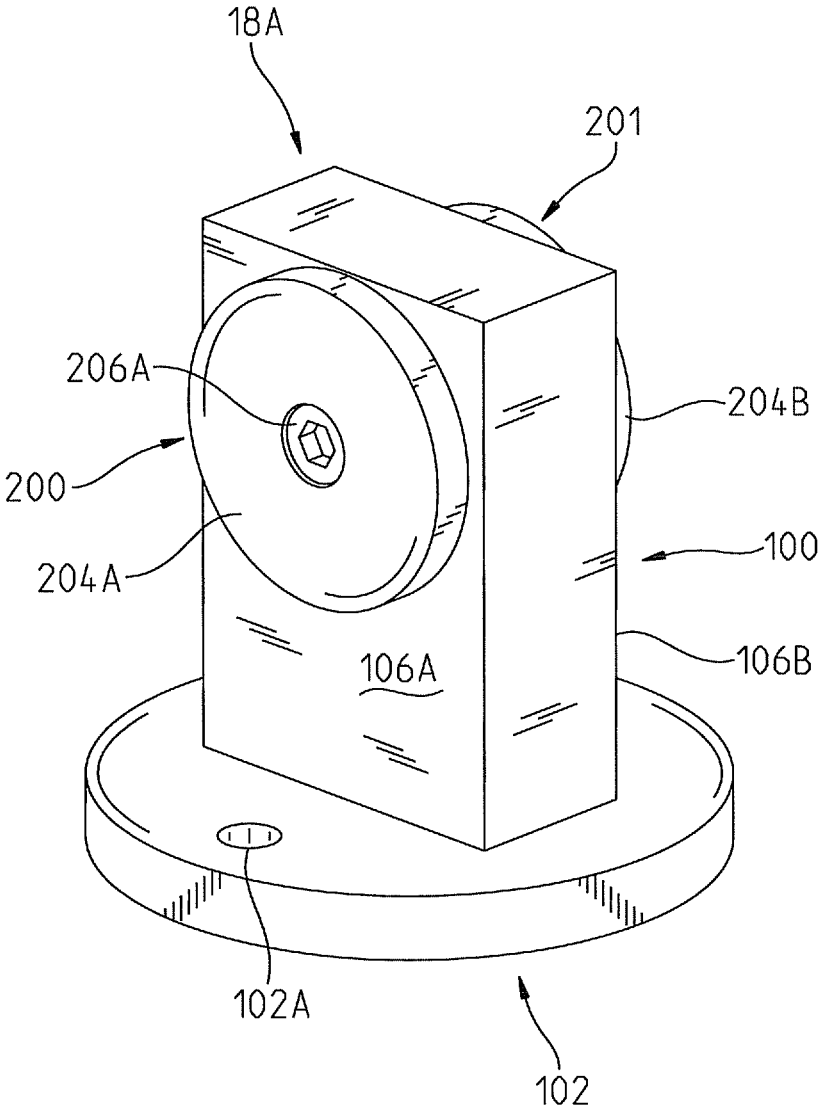
FIG. 3 is a perspective view of a torque pin assembly according to the present invention.

The first torque pin assembly 18A is illustrated in FIGS. 2-3. The second torque pin assembly 18B is constructed in substantially the same manner as the first torque pin assembly 18A. Hence, the discussion below of the first torque pin assembly 18A applies as well to the second torque pin assembly 18B.

The first torque pin assembly 18A comprises an elongated body 100 and a head section 102 integral with the elongated body 100. The head section 102 has a circular shape in the illustrated embodiment. Bores 102A are provided in the head section for receiving bolts 102B for fastening the torque pin assembly 18A to the engine casing 12. First and second recesses (only the first recess 104A is shown in FIG. 2) are formed in opposing first and second sides 106A and 106B of the elongated body 100. The torque pin assembly 18A further comprising first and second variable thickness defining structures 200 and 201 according to present invention as shown.

In the illustrated embodiment, the first variable thickness defining structure 200 comprises one or more first shims 202A, a first stepped puck 204A, and a first bolt 206A. The second variable thickness defining structure 201 comprises one or more second shims 202B, a second stepped puck 204B, and a second bolt 206B. The first and second stepped pucks 204A and 204B have a first section 1204A, 1204B having a first diameter and a second section 2204A, 2204B having a second diameter larger than the first diameter. The one or more first shims 202A and the first section 1204A of the first puck 204A are capable of being received in the first recess 104A in the first side 106A of the elongated body 100. The one or more second shims 202B and the first section 12048 of the second puck 2048 are capable of being received in the second recess in the second side 106B of the elongated body 100. The first and second shims 202A and 202B may have any suitable size and shape, e.g., round or rectangular, so long as they fit between the first and second pucks 204A and 204B and the elongated body 100 and in the recesses in the elongated body 100. It is also contemplated that the one or more first shims 202A and the one or more second shims 202B may have different thicknesses so as to effect a more accurate adjustment within operating tolerances. Although the recesses in the elongated body 100 shown here are generally cylindrical, the size, position and shape of the recesses may be configured accordingly to facilitate the engagement of the torque pin assembly 18A with the blade ring 14. The first and second shims 202A and 202B are not illustrated in FIG. 1.

Bores 202C are provided in the first and second shims 202A and 202B and bores 204C are provided in the first and second pucks 204A, 204B. The first bolt 206A passes through the bores 202C and 204C in the one or more first shims 202A and the first puck 204A and threadedly engages a bore 106C in the elongated member 100 so as to secure the one or more first shims 202A and the first puck 204A to the elongated member 100. The second bolt 206B passes through the bores 202C and 204C in the one or more second shims 202B and the second puck 204B and threadedly engages a bore 106D in the elongated member 100 so as to secure the one or more second shims 202B and the second puck 204B to the elongated member 100. As will be discussed below, depending upon a desired vertical distance between the rotor 15 and the blade ring 14, zero or one or more first shims 202A and zero or one or more second shims 2028 may be placed in the first and second recesses in the first and second sides 106A and 106B of the elongated body 100.

Figure 4:
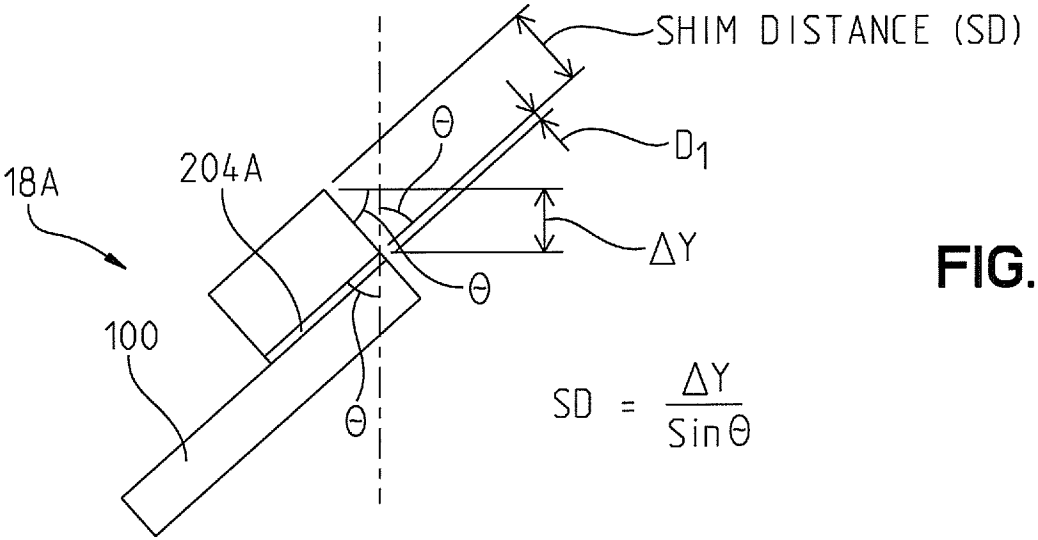
FIG. 4 is a diagram showing a blade ring in two spaced apart positions and torque pin assemblies engaging the blade ring.
Figure 5:
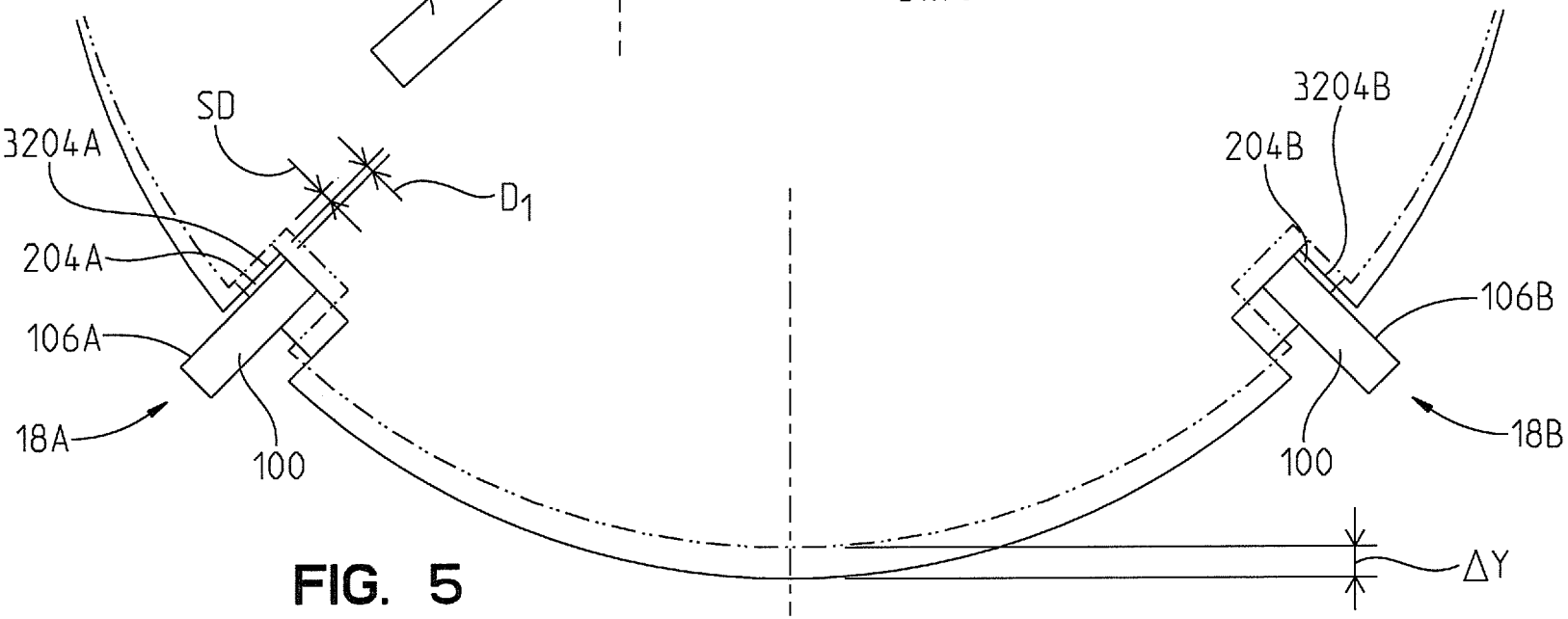
FIG. 5 is an illustration of a diagram and a trigonometric expression for determining a change in the thickness of a variable thickness defining structure of a torque pin assembly to effect a desired vertical movement of the blade ring.

A process for setting or adjusting a vertical spacing between the rotor 15 and the blade ring 14 will now be described. Initially, a technician determines an amount of vertical movement needed to reposition the blade ring 14 relative to the rotor 15 in a manner known to those skilled in the art so as to achieve a desired total vertical spacing between the rotor 15 and the blade ring 14. In the example illustrated in FIGS. 4 and 5, it is presumed that ΔY is the determined amount of upward vertical movement needed to correctly position the blade ring 14 relative to the rotor 15. In FIG. 5, the blade ring 14 is illustrated in solid line in an initial position and in phantom in a position after it has been raised by ΔY. The first puck 204A of the first torque pin assembly 18A is shown in solid line in an initial position such that an outer surface 3204A of the first puck 204A is spaced a first distance $D_1$ from the first side 106A of the elongated body 100. The second puck 204B of the second torque pin assembly 18B is also shown in solid line in an initial position such that an outer surface 3204B of the second puck 204B is spaced a similar distance from the second side 1068 of the elongated body 100. The first puck 204A of the first torque pin assembly 18A and the second puck 204B of the second torque pin assembly 18B are the load bearing pucks of the first and second assemblies 18A and 18B.

The thickness of the first variable thickness defining structure 200 of the first torque pin assembly 18A is equal to the first distance $D_1$, i.e., the distance between the outer surface 3204A of the first puck 204A and the first side 106A of the elongated body 100.

A change in thickness of the first variable thickness defining structure 200 of the first torque pin assembly 18A can be calculated using the following equation:

$$SD=\Delta Y/\sin\theta$$

where SD denotes the change in the thickness of the first variable thickness defining structure 200 of the first torque pin assembly 18A required to effect the determined amount of vertical movement ΔY of the blade ring 14 relative to the rotor 15. The change in the thickness SD is effected at the first torque pin assembly 18A by adding or removing shims 202A between the first puck 204A and the elongated body 100. Angle θ denotes the angle between vertical and the outer surface 3204A of the first puck 204A or a longitudinal axis of the main body 100, both of the first torque pin assembly 18A. Hence, the total thickness of the first variable thickness defining structure 200 to effect the determined amount of movement ΔY of the blade ring 14 relative to the rotor 15 is equal to the initial thickness $D_1$ of the first variable thickness defining structure 200 plus SD, i.e., the change in the thickness of the first variable thickness defining structure 200.

The thickness of the second variable thickness defining structure 201 at the second torque pin assembly 18B is equal to a distance between the outer surface 3204B of the second puck 204B and the second side 106B of the elongated body 100.

SD also denotes the change in the thickness of the second variable thickness defining structure 201 of the second torque pin assembly 18B required to effect the determined amount of movement ΔY of the blade ring 14 relative to the rotor 15. The change in the thickness SD is effected at the second torque pin assembly 18B by adding or removing shims 202B between the second puck 204B and the elongated body 100.

When the torque pin assembly locations circumferentially spaced on the outer surface 12A of the casing 12 are fixed (i.e., θ is a constant value), the change in vertical spacing ΔY between the blade ring 14 and the rotor 15 is primarily effected by changing the value of SD. That is, if the blade ring 14 needs to be moved away from the rotor 15 in a vertical direction (i.e. ΔY decreases), SD or the number of shims can be accordingly reduced such that the blade ring 14 is lowered inside the engine. If the blade ring 14 needs to be moved closer to the rotor 15 (i.e., ΔY increases), additional shims can be added accordingly without having to replace the torque pin assembly entirely. The engine would then be remeasured and calculations are to be corrected if needed.

Even though one side of each of the torque pin assemblies 18A and 18B is loaded (i.e., support the weight of the blade ring 14), it is preferred that the opposite sides are shimmed to make sure there is no excessive gap in the recesses 22A and 22B of the blade ring 14 as it may allow the blade ring to shift. Hence, sufficient shims 202B are provided so that the location of the outer surface of the second puck 204B of the first torque pin assembly 18A engages with a corresponding inner surface defining the first recess 22A in the blade ring 14 and sufficient shims 202A are provided so that the location of the outer surface of the first puck 204A of the second torque pin assembly 18B engages with a corresponding inner surface defining the second recess 22B in the blade ring 14.

It is believed that the torque pin assembly of the present invention allows for an adjustment to the spacing between a blade ring and a rotor to be made more efficiently/quickly by varying the number of shims as compared to prior processes where torque pins had to be machined or replaced.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for adjusting a position of a blade ring relative to a rotor in a gas turbine engine, wherein an outer casing surrounds the blade ring and the blade ring surrounds the rotor, comprising:

determining an amount of vertical movement needed to reposition the blade ring relative to the rotor so that the blade ring is at a desired position relative to the rotor;

providing at least one torque pin assembly comprising a torque pin and a variable thickness defining structure;

determining a change in the thickness of the variable thickness defining structure so as to effect the necessary vertical movement of the blade ring;

changing the thickness of the variable thickness defining structure;

coupling the at least one torque pin assembly to the outer casing such that at least one torque pin engages the blade ring;

the variable thickness defining structure comprises one or more shims removably coupled to the torque pin;

the torque pin comprises an elongated body for projecting radially inward through a bore in the outer casing and engaging the blade ring, the elongated body having at least one recess;

the one or more shims being received in the at least one recess;

the variable thickness defining structure further comprises at least one removable member for being received in the at least one recess; and structure to secure the at least one removable member and the one or more shims to the elongated body.

2. The method of claim 1, wherein determining a change in the thickness of the variable thickness defining structure is calculated using the following equation:

$$SD=\Delta Y/\sin\theta$$

where SD=change in the thickness of the variable thickness defining structure;

ΔY=the determined vertical movement of the blade ring;

θ=the angle between vertical and a longitudinal axis of the at least one torque pin assembly.

3. A gas turbine engine comprising:

an outer casing;

a rotor located within the outer casing;

a blade ring positioned between the rotor and the outer casing; and at least one torque pin assembly comprising a torque pin and a variable thickness defining structure, said assembly being coupled to said outer casing and engaging said blade ring so as to determine the vertical spacing between said blade ring and said rotor, said variable thickness defining structure comprising one or more shims removably coupled to said torque pin, wherein said torque pin comprises an elongated body for projecting radially inward through a bore in said outer casing and engaging said blade ring, said elongate body having at least one recess and said one or more shims being received in said at least one recess, wherein said variable thickness defining structure further comprises at least one removable member for being received in said at least one recess; and structure to secure said at least one removable member and said one or more shims to said elongated body.

4. The gas turbine engine of claim 3, wherein said at least one torque pin assembly comprises first and second torque pin assemblies comprising first and second torque pins extending through corresponding bores in said engine casing and having longitudinal axes extending at an angle to vertical.

* * * * *